US011008706B2

(12) United States Patent
Sekiya et al.

(10) Patent No.: US 11,008,706 B2
(45) Date of Patent: May 18, 2021

(54) CANVAS CLEANING DEVICE, CANVAS CLEANING METHOD AND CANVAS CLEANING MECHANISM

(71) Applicant: MAINTECH CO., LTD., Tokyo (JP)

(72) Inventors: Hiroshi Sekiya, Tokyo (JP); Tomohiko Nagatsuka, Fuji (JP); Kazuyuki Yusa, Fuji (JP)

(73) Assignee: MAINTECH CO., LTD., Tokyo (JP)

( * ) Notice: Subject to any disclaimer, the term of this patent is extended or adjusted under 35 U.S.C. 154(b) by 0 days.

(21) Appl. No.: 16/486,542

(22) PCT Filed: Mar. 29, 2019

(86) PCT No.: PCT/JP2019/014331
§ 371 (c)(1),
(2) Date: Aug. 16, 2019

(87) PCT Pub. No.: WO2019/189879
PCT Pub. Date: Oct. 3, 2019

(65) Prior Publication Data

US 2020/0340181 A1 Oct. 29, 2020

(30) Foreign Application Priority Data

Mar. 30, 2018 (JP) ..... JP2018-069867

(51) Int. Cl.
*D21F 1/32* (2006.01)
*D21F 7/12* (2006.01)
(Continued)

(52) U.S. Cl.
CPC ..... *D21F 7/12* (2013.01); *B08B 3/024* (2013.01); *B08B 3/08* (2013.01); *D21F 1/32* (2013.01)

(58) Field of Classification Search
CPC ... D21F 1/32; D21F 1/325; D21F 1/34; D21F 1/345; B08B 3/022; B08B 3/024; B08B 3/041
(Continued)

(56) References Cited

U.S. PATENT DOCUMENTS 6,491,764 B2 * 12/2002 Mertens ..... G03F 7/423 134/2
2004/0045589 A1 * 3/2004 Holsteyns ..... H01L 21/6708 134/32
2010/0043843 A1 * 2/2010 Droscher ..... D21F 1/325 134/95.3

FOREIGN PATENT DOCUMENTS

DE 102007031314 A1 * 1/2009 ..... H01L 21/6708
JP H08-503900 A 4/1996
(Continued)

OTHER PUBLICATIONS

JP 2009-144304, English language machine translation [epo.org]. (Year: 2009).*

*Primary Examiner* — Eric Hug
(74) *Attorney, Agent, or Firm* — Muncy, Geissler, Olds & Lowe, P.C.

(57) ABSTRACT

[Problem]
To provide a canvas cleaning device that can prevent re-adhesion of stains as much as possible and also efficiently clean the canvas.
[Solution]
The canvas cleaning device 100 is provided with a base part 11 capable of sliding along a rail part 1 that extends in a width direction of a canvas K1, a cone part 13 having a cylinder shape, which is attached to the base part 11, and extends straightly, a high pressure water spraying device 13*a* installed inside the cone part 13, an arm part 15 that is extended and installed on the downstream side from the base
(Continued)

part 11 and a nozzle device 16 attached to the tip of the arm part 15, and in this structure, high pressure water is sprayed onto the canvas K1 from the high pressure water spraying device 13*a* inside the cone part 13.

14 Claims, 9 Drawing Sheets

(51) Int. Cl.
*B08B 3/02* (2006.01)
*B08B 3/08* (2006.01)

(58) Field of Classification Search
USPC ..... 162/199, 272, 274–279; 134/15, 64 R, 134/122 R
See application file for complete search history.

(56) References Cited

FOREIGN PATENT DOCUMENTS

| | | | | |
|---|---|---|---|---|
| JP | 2008-7897 | A | | 1/2008 |
| JP | 2009-144304 | | * | 7/2009 |
| JP | 2009-144304 | A | | 7/2009 |
| JP | 4918024 | B2 | | 4/2012 |
| JP | 2016-185519 | A | | 10/2016 |
| JP | 2018-168498 | A | | 11/2018 |
| WO | 2014/136445 | A1 | | 9/2014 |

* cited by examiner

CANVAS CLEANING DEVICE, CANVAS CLEANING METHOD AND CANVAS CLEANING MECHANISM

TECHNICAL FIELD

The present invention relates to a canvas cleaning device, a canvas cleaning method and a canvas cleaning mechanism, and more specifically, concerns a canvas cleaning device for cleaning a canvas of a paper machine while transporting the canvas, a canvas cleaning method using such a canvas cleaning device and a canvas cleaning mechanism provided with such a canvas cleaning device.

BACKGROUND ART

A paper machine for producing paper is provided with a wire part that mounts a liquid generally formed by dispersing pulp in water on a net (wire) for use in forming paper and allows excessive water to naturally drop to make wet paper, a press part that allows the wet paper to pass between a pair of press rollers and by pressing it with the press rollers with felt interposed therebetween so that moisture in the wet paper is transferred to the felt, thereby dehydrating the wet paper, a dryer part that dries the wet paper that has passed through the press rollers by making it in contact with a heated dryer roller with a canvas interposed therebetween so as to be formed into paper and a reel part that takes up the paper onto a rod referred to as a spool.

In the dryer part, by transporting the wet paper in a manner so as to be wound around the surface of each of a plurality of heated dryer rollers, the corresponding wet paper is dried. At this time, a so-called canvas is used for pressing the wet paper onto the surface of the dryer roller from the outside thereof. That is, between the dryer rollers, the canvas is transported together with the wet paper, while being made in contact with the wet paper.

In this case, since the canvas is made in contact with the wet paper as described above, its surface might be contaminated because paper dust or the like contained in the wet paper is transferred thereto. Moreover, in the case when the canvas in the contaminated state is continuously used, the stains on the canvas is undesirably transferred onto the succeeding wet paper, causing serious deterioration in the production yield of paper.

For this reason, a cleaning device for cleaning the canvas has been developed.

For example, a canvas cleaning device has been known in which a supply means for directly supplying a stain preventive agent onto the contact surface of the canvas with which the wet paper is made in contact, a high pressure water spraying means for spraying high pressure water having a pressure of 10 MPa or more onto the contact surface of the canvas on which the stain preventive agent has been supplied by the supply means and a suction means for sucking the vicinity of a portion with which the high pressure water collide on the contact surface of the canvas are provided (for example, see Patent Literature 1).

Moreover, a dryer in a paper machine has been known in which a scraper device for scraping adhered substances onto the canvas surface, which is located on a return-side canvas positioned above a carrier-side canvas, a pressure water spraying device for spraying pressure water over the entire width direction of the return-side canvas, which is located on the front side in the moving direction from the scraper device to the return-side canvas, a separating agent spraying device for spraying a water-soluble separating agent over the entire width direction of the return-side canvas, which is located on the front side in the moving direction from the pressure water spraying device to the return-side canvas, are installed (for example, see Patent Literature 2).

CITATION LIST

Patent Literature

PTL 1: Japanese Patent Application Laid-Open No. 2008-7897

PTL 2: Japanese Patent No. 4918024

SUMMARY OF INVENTION

Technical Problem

However, in the canvas cleaning device disclosed in the above-mentioned PTL 1, the supply means for supplying a stain preventive agent and the high pressure water spraying means are installed; however, the two means are separated means and since these are located with a fixed distance spaced from each other, stains might re-adhere when it is transported therebetween. That is, even if the stains such as pitch, paper powder or the like are separated from the canvas by the high pressure water spraying means, the stains, such as pitch, paper powder or the like, are solidified because the canvas is heated and dried by the dryer during transportation, and might re-adhere to the canvas. Additionally, a method in which the supply means and the high pressure water spraying means are brought close to each other may be proposed; however, since the two means are substantially large devices, it is difficult to bring the two means close to each other also from the viewpoint of designing the entire drying part.

In the dryer disclosed in the above-mentioned PTL 2, the pressure water spraying device and the separating agent spraying device are installed; however, since stains, such as pitch, paper powder or the like might re-adhere to the canvas at the time of transporting between the two devices in the same manner as described above, it is also difficult to bring the two devices close to each other.

Moreover, any of the canvas cleaning device of the above-mentioned PTL1 and the dryer of the above-mentioned PTL2 cannot be said to have an excellent cleaning efficiency.

In view of the above-mentioned circumstances, the present invention has been devised, and its object is to provide a canvas cleaning device capable of preventing re-adhesion of stains as much as possible and of also cleaning a canvas efficiently, a canvas cleaning method using the canvas cleaning device and a canvas cleaning mechanism provided with the canvas cleaning device.

Solution to Problems

The inventors, etc. of the present invention have extensively studied so as to solve the above-mentioned problems, and have found that by providing a configuration in which a cone part that is attached to a base part and has a high pressure water spraying device installed therein and a nozzle device that is attached with an arm part formed on the base part extending therefrom interposed therebetween, are disposed along the transporting direction straightly, with the base part being made slidable along a rail part, the above-mentioned problems can be solved, so that the present invention is completed.

The present invention, which relates to (1) a canvas cleaning device for cleaning a canvas of a paper machine while transporting the canvas, is provided with a base part that is slidable along a rail part extending in the width direction of the canvas, a cone part that is attached to the base part so as to extend straightly, a high pressure water spraying device for spraying high pressure water onto the canvas formed inside the cone part, an arm part that is formed so as to extend on a downstream side from the base part, and a nozzle device that is attached to the tip of the arm part and used for spraying chemical solution onto the canvas, and the canvas cleaning device is characterized in that the cone part and the nozzle device are disposed straightly along the transporting direction, and the nozzle device is positioned on the downstream side from the cone part and inside the cone part, so that the high pressure water is sprayed onto the canvas from the high pressure water spraying device.

The present invention relates to the canvas cleaning device disclosed in the above-mentioned (1) in which (2) the cone part is installed at a position opposed to a guide roller for guiding the canvas, with the canvas being interposed therebetween, and the distance from a contact part at which the canvas is released from the guide roller to a position at which the nozzle device sprays chemical solution onto the canvas is set to 200 to 1000 mm.

The present invention relates to the canvas cleaning device disclosed in the above-mentioned (1) or (2) in which (3) the nozzle device is provided with a chemical solution nozzle part for spraying a chemical solution and a pair of air nozzle parts for spraying a chemical solution formed so as to sandwich the chemical solution nozzle part, and the chemical solution nozzle part and the pair of air nozzle parts are disposed straightly along the transporting direction.

The present invention relates to the canvas cleaning device disclosed in any one of the above-mentioned (1) to (3) in which (4) the chemical solution is a stain preventive agent composition including at least one kind selected from the group consisting of amino modified silicone oil, epoxy modified silicone oil, polyether modified silicone oil, polybutene, vegetable oil and synthetic ester oil, and the chemical solution has an absolute value of zeta potential in a range from 3 to 100 mV.

The present invention relates to the canvas cleaning device disclosed in any one of the above-mentioned (1) to (4), which is further provided with (5) a negative pressure generating device for setting the inside of the cone part to a negative pressure, and inside the cone part, high pressure water is sprayed from the high pressure water spraying device onto the canvas, with the high pressure water being sucked by the negative pressure generating device.

The present invention relates to the canvas cleaning device disclosed in any one of the above-mentioned (1) to (4), which is further provided with (6) an auxiliary arm part attached to the base part, the arm part or the cone part and an air knife for blowing air to the canvas attached to the tip of the auxiliary arm part, and the cone part, the air knife and the nozzle device are disposed straightly along the transporting direction, with the air knife being located between the cone part and the nozzle device.

The present invention relates to the canvas cleaning device disclosed in any one of the above-mentioned (1) to (4), which is further provided with (7) an auxiliary arm part attached to the base part, the arm part or the cone part, an air knife for blowing air to the canvas attached to the tip of the auxiliary arm part and a negative pressure generating device for setting the inside of the cone part to a negative pressure, and the cone part, the air knife and the nozzle device are disposed straightly along the transporting direction, with the air knife being located between the cone part and the nozzle device, and high pressure water is blown to the canvas from the high pressure water spraying device inside the cone part, and the high pressure water is sucked by the negative pressure generating device.

The present invention relates to the canvas cleaning device disclosed in the above-mentioned (6) or (7) in which (8) the cone part has diameter Wd in the width direction on a cross section perpendicular to the longitudinal direction that is set to 0.04 to 0.5 m and the nozzle device has chemical solution spraying width Wc on the canvas of the chemical solution that is instantaneously sprayed therefrom, and set to 0.015 to 0.2 m, with diameter Wd and chemical solution spraying width Wc satisfying the following relationship: $Wc \leq Wd$.

The present invention relates to a canvas cleaning method using the canvas cleaning device disclosed in the above-mentioned (5) or (7) in which (9) supply water amount Qw of the high pressure water given by the high pressure water spraying device is set in a range from 500 to 5000 ml/min, recovery amount Qa of the high pressure water by the negative pressure generating device is set in a range from 200 to 4850 ml/min and apply amount Qc of the chemical solution by the nozzle device is set in a range from 150 to 20000 mg/min as an effective component amount, and supply water amount Qw, recovery amount Qa and apply amount Qc satisfy the following relationship $(Qw-Qa)/Qc \leq 25$.

The present invention relates to a canvas cleaning method using the canvas cleaning device disclosed in the above-mentioned (7) in which (10) supply water amount Qw of the high pressure water given by the high pressure water spraying device is set in a range from 500 to 5000 ml/min, recovery amount Qa of the high pressure water by the negative pressure generating device is set in a range from 200 to 4850 ml/min and water amount Qn removed by the air knife is set in a range from 200 to 1455 ml/min and apply amount Qc of the chemical solution by the nozzle device is set in a range from 150 to 20000 mg/min as an effective component amount, and supply water amount Qw, recovery amount Qa, removed water amount Qn and apply amount Qc satisfy the following relationships: $(Qw-Qa)/Qc \leq 25$ and $(Qw-Qa-Qn)/Qc \leq 15$.

The present invention relates to a canvas cleaning method disclosed in the above-mentioned (9) or (10) in which (11) diameter Wd in the width direction on the cross section perpendicular to the longitudinal direction of the cone part is set in a range from 0.04 to 0.5 m and diameter Wd and distance W through which the base part slides while the canvas makes a turn satisfy the following relationship: $0.01\ Wd \leq W \leq 3\ Wd$.

The present invention relates to (12) a canvas cleaning mechanism provided with the canvas cleaning device described in any one of the above-mentioned (1) to (8) and a recovery box for recovering water dropped from the guide rollers for guiding the canvas, and the recovery box has a box shape extending in the width direction of the canvas, with the upper surface being opened, and the cone part of the canvas cleaning device is installed at a position opposed to the guide roller, with the canvas interposed therebetween, and the recovery box is disposed below the guide roller.

Advantageous Effects of Invention

Since the canvas cleaning device of the present invention is provided with the cone part and the high pressure water spraying device installed inside the cone part, the high pressure water spraying device sprays high pressure water to the canvas in a region surrounded by the cone part so that stains, such as pitch, paper powder and the like, contained on the canvas can be extruded. Thus, the stains, such as pitch, paper powder and the like, adhered to the canvas can be removed.

At this time, the cone part, which has a structure that is extended straightly from the base part downward, makes it possible to suck stains and moisture smoothly with high efficiency.

In addition to this, the canvas cleaning device of the present invention is further provided with a nozzle device that is disposed straightly in the transporting direction on the downstream side of the cone part; therefore, onto the canvas from which stains and moisture have been removed by the passage through the cone part, the chemical solution can be applied. Thus, effects derived from the chemical solution can be sufficiently exerted.

At this time, since the distance between the cone part and the nozzle device can be sufficiently narrowed, it is possible to prevent re-adhesion of stains as much as possible.

Moreover, in the canvas cleaning device, by allowing the base part to which the cone part and the nozzle device are attached to be slidable along the rail part, the canvas cleaning device makes it possible to apply the high pressure water and chemical solution to the canvas while moving. Thus, the entire canvas can be cleaned, and the canvas cleaning device itself can be made compacter.

In the canvas cleaning device of the present invention, since the cone part is installed at a position opposed to the guide rollers for guiding the canvas, with the canvas being interposed therebetween, it becomes possible to prevent the high pressure water sprayed by the high pressure water spraying device from passing through the canvas.

Moreover, by setting the distance from the contact part at which the canvas is released from the guide roller to the position at which the nozzle device sprays the chemical solution to the canvas to the above-mentioned range, it becomes possible to sufficiently prevent re-adhesion of stains.

In the canvas cleaning device of the present invention, since the nozzle device is provided with the chemical solution nozzle part for spraying chemical solution and the paired air nozzle parts installed in a manner so as to sandwich the chemical solution nozzle part, and since the chemical solution to be sprayed from the chemical solution nozzle part is sprayed in such a state as to be sandwiched between air flows that are blown from the air nozzle part, it is possible to prevent the chemical solution from being scattered. Thus, the chemical solution can be efficiently sprayed onto the canvas.

In the canvas cleaning device of the present invention, in the case when the chemical solution is made of a stain preventive agent composition including at least one kind selected from the group consisting of amino modified silicone oil, epoxy modified silicone oil, polyether modified silicone oil, polybutene, vegetable oil and synthetic ester oil, it is possible to suppress paper powder and pitch contained in wet paper from adhering to the canvas.

At this time, in the case when the chemical solution has an absolute value of zeta potential in a range from 3 to 100 mV, since the chemical solution is allowed to easily adhere to the canvas, a sufficient amount of the chemical solution can be remained on the surface of the canvas.

In the canvas cleaning device of the present invention, since the negative pressure generating device for setting the inside of the cone part to a negative pressure is further installed, the high pressure water spraying device sprays high pressure water to the canvas in a region surrounded by the cone part so that stains, such as pitch, paper powder and the like, contained on the canvas can be extruded and these can be entirely sucked by the negative pressure generating device. Thus, the amount of the high pressure water remaining on the canvas inside the cone part can be reduced as much as possible.

In the canvas cleaning device of the present invention, since the air knife for use in spraying air onto the canvas is further provided, moisture contained in the canvas can be sufficiently blown off.

In this case, the air knife is desirably disposed between the cone part and the nozzle device so as to be straightly aligned. In this case, since the moisture (high pressure water) remaining on the canvas is blown off by the air knife, the chemical solution to be sprayed by the nozzle device is then further easily adhered onto the canvas.

At this time, by setting diameter Wd in the width direction on a cross section perpendicular to the longitudinal direction of the cone part and chemical solution spraying width Wc on the canvas of the chemical solution to be instantaneously sprayed by the nozzle device to the above-mentioned ranges, and diameter Wd and chemical solution spraying width Wc satisfy the following relationship: $Wc \leq Wd$, the chemical solution can be applied to the canvas from which stains and moisture have been more sufficiently removed.

In the cleaning method of the canvas in the present invention, by setting supply water amount Qw of the high pressure water by the high pressure water spraying device, recovery amount Qa of the high pressure water by the negative pressure generating device and apply amount Qc of the chemical solution by the nozzle device to the above-mentioned ranges, and supply water amount Qw, recovery amount Qa and apply amount Qc satisfy the following relationship: $(Qw-Qa)/Qc \leq 25$, effects derived from the chemical solution can be sufficiently exerted.

Moreover, in addition to this, by allowing supply water amount Qw, recovery amount Qa, removed water amount Qn and apply amount Qc to satisfy the following relationship: $(Qw-Qa-Qn)/Qc \leq 15$, effects derived from the chemical solution can be sufficiently exerted.

Moreover, in the canvas cleaning method of the present invention, by setting diameter Wd in the width direction on the cross section perpendicular to the longitudinal direction of the cone part to the above-mentioned range, and diameter Wd and distance W through which the base part slides while the canvas makes a turn satisfy the following relationship: $0.01\ Wd \leq W \leq 3\ Wd$, the cone part is allowed to slide in a manner so as not to cause a gap relative to the canvas. That is, the spraying process of high pressure water by the high pressure water spraying device and the suction process by the negative pressure generating device can be uniformly exerted on the entire canvas.

In the canvas cleaning mechanism of the present invention, since the canvas cleaning device is installed, the above-mentioned effects can be exerted, and since the recovery box is installed, water dropping from the guide rollers can be prevented from adhering to the wet paper and other portions.

DESCRIPTION OF EMBODIMENTS

Figure 1:
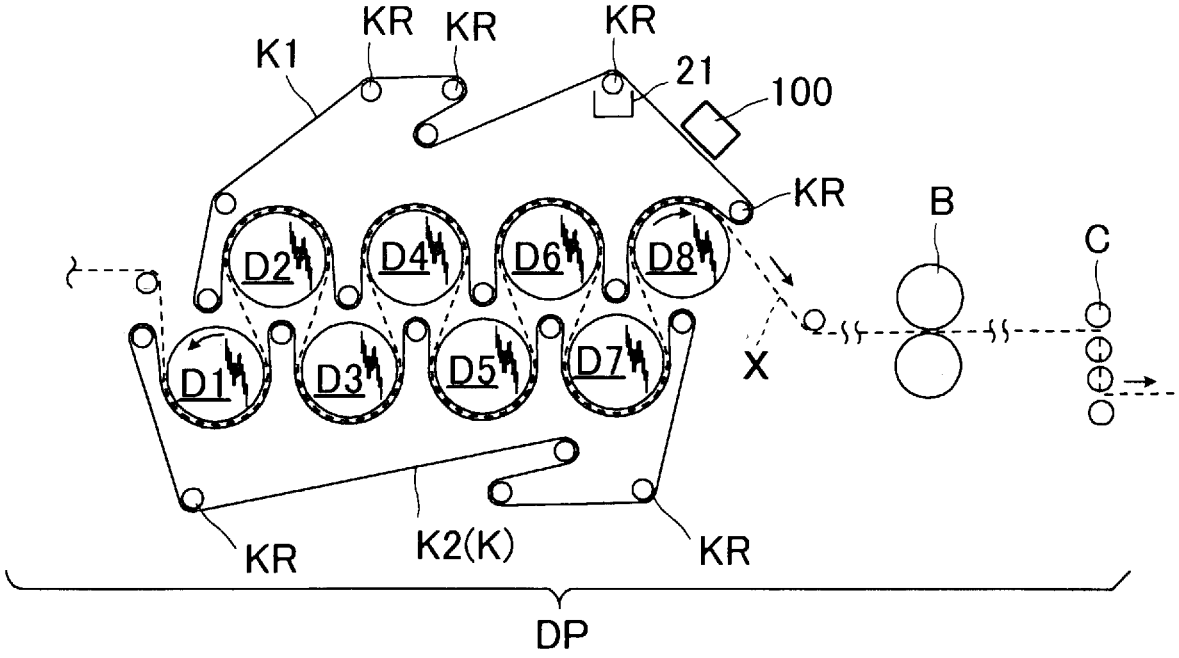
FIG. 1 is a schematic view showing a drying part in which a canvas cleaning device relating to the present invention is installed.

Referring to Figs. on demand, the following description will explain a preferable embodiment of the present invention in detail. Additionally, in the Figs., the same components are indicated by the same reference numerals, and overlapped explanations will be omitted. Moreover, positional relationships, such as those in longitudinal and lateral directions, are based upon positional relationships indicated by the Figs., without not otherwise specified. Moreover, the dimension ratios of the Figs. are not intended to be limited by the ratios shown in the Figs.

The canvas cleaning device in accordance with the present invention is a device for cleaning a canvas while transporting the canvas in a dryer part in a paper machine.

FIG. 1 is a schematic view showing a drying part in which the canvas cleaning device relating to the present invention is installed.

As shown in FIG. 1, a drying part DP of the paper machine is provided with a plurality of cylinder shaped dryer rollers (Yankee dryers) D1, D2, D3, D4, D5, D6, D7 and D8 (hereinafter, referred to as "D1 to D8"), which guide wet paper X while heating and drying it, a canvas K1 on the upper side and a canvas K2 on the lower side that transport wet paper X while pressing it onto the dryer rollers D1 to D8, guide rollers KR for guiding each of the canvases K1 and K2, a breaker stack roller B that rotates, while temporarily pressing the wet paper X heated and dried thereon by the dryer rollers D1 to D8 and a calendar roller C that rotates while pressing the wet paper X temporarily pressed by the breaker stack roller B. That is, the drying part DP is provided with the dryer rollers D1 to D8, the canvases K1 and K2, the breaker stack roller B and the calendar roller C.

Additionally, below the guide rollers KR, a recovery box 21 is installed, and the recovery box 21 will be described later.

In the drying part DP, wet paper X is pressed onto the surfaces of the rotating dryer rollers D1 to D8 by the canvases K1 and K2. Thus, the wet paper X is adhered to the dryer rollers D1 to D8 and simultaneously heated and dried. Additionally, the wet paper X is then pressed by the breaker stack roller B and the calendar roller C so as to be densified, and also has its smoothness and paper thickness adjusted.

In the drying part DP, as described earlier, the canvas K1 is transported together with the wet paper X, while pressing the wet paper X. Moreover, after the wet paper X has passed through the dryer roller D8 at the rear end, it is further guided to the dryer roller D2 at the front end by the guide rollers KR so that succeeding wet paper X is again pressed. That is, the canvas K1 has a loop shape guided by the guide rollers KR, and is designed to continuously rotate. Additionally, with respect to the canvas K2 also, it is rotated in the same manner as in the canvas K1.

A canvas cleaning device 100 is installed at a position on a surface side (above the canvas K1 indicated by FIG. 1) that is made in contact with the wet paper X of the canvas K1 when the canvas K1 is separated from the wet paper X and turned around to be transported, and is also opposed to the guide rollers KR. More specifically, the cone part of the canvas cleaning device 100 is installed at a position that is opposed to the guide rollers KR for guiding the canvas K1, with the canvas K1 interposed therebetween.

In this manner, by disposing the canvas cleaning device 100 at a position opposed to the guide rollers KR, high pressure water to be sprayed by a high pressure water spraying device is prevented from passing through the canvas K1.

At this time, the length of the canvas K1 in the transporting direction of the canvas K1 from the position of the canvas K1 at which high pressure water is sprayed by the canvas cleaning device 100 to the position of the canvas K1 at which it is started to be made in contact with paper is preferably set to 5 m or less. With this arrangement, the probability of new stains adhering to the canvas can be reduced extremely.

Figure 2:
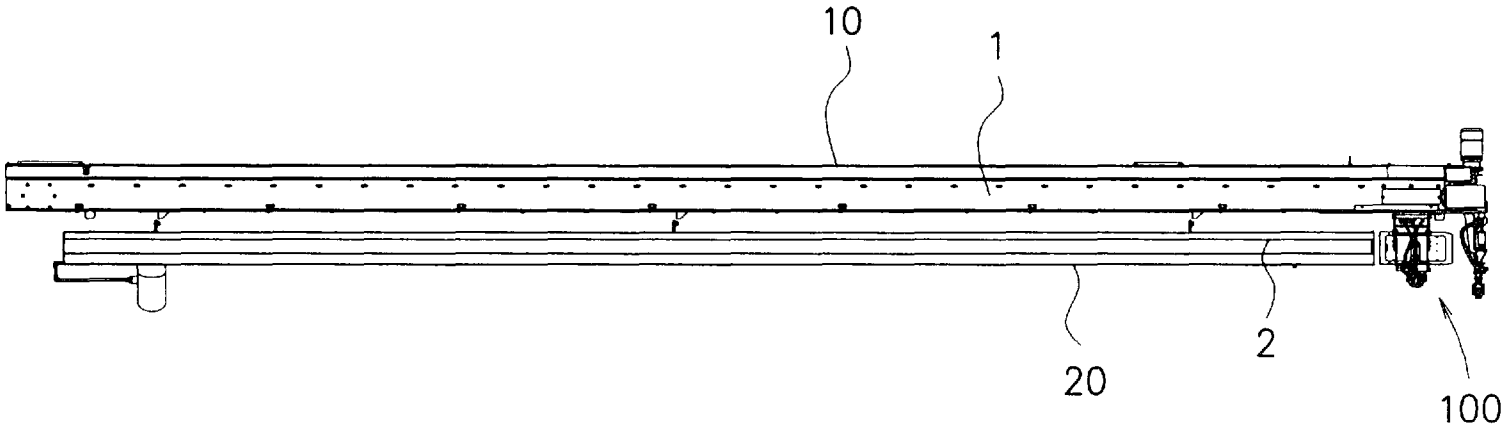
FIG. 2 is a front view showing the canvas cleaning device relating to the present embodiment.

FIG. 2 is a front view showing the canvas cleaning device relating to the present embodiment.

As shown in FIG. 2, the canvas cleaning device 100 has its base part allowed to slide along a rail part 1 (hereinafter, referred to as "first rail part 1" on demand) that extends in the width direction (direction perpendicular to the transporting direction of the canvas on the canvas surface) of the canvas (not shown). That is, the canvas cleaning device 100 is designed to clean the transported canvas, while moving in the width direction of the canvas. Thus, it is possible to clean the entire canvas.

The rail part 1 is attached to a beam part 10, and the beam part 10 has its two ends supported by a frame (not shown) so as not to intervene with the transportation of the canvas.

The beam part 10 has a hollow rectangular parallelepiped shape, and includes a tube (not shown) through which air passes, a tube (not shown) through which water passes and a tube (not shown) through which chemical solution passes, installed therein. That is, through these tubes, to a high pressure water spraying device, a nozzle device, an air knife and the like to be described later, air, water and chemical solution corresponding to these tubes are supplied.

Moreover, the canvas cleaning device 100 is also designed to slide along a rail part 2 (hereinafter, referred to as "second rail part 2" on demand) that is attached to a save all part 20 that extends in the width direction of the canvas. Additionally, these will be described later in detail.

The save all part 20 is supported by the beam part 10 so as not to intervene with the transportation of the canvas. Additionally, the beam part 10 and the save all part 20 are disposed in parallel with each other.

The save all part 20 has a hollow rectangular parallelepiped shape, and is allowed to recover moisture sucked by a negative pressure generating device to be described later. Thus, the canvas cleaning device 100 also becomes superior in the recovery efficiency of moisture.

Figure 3:
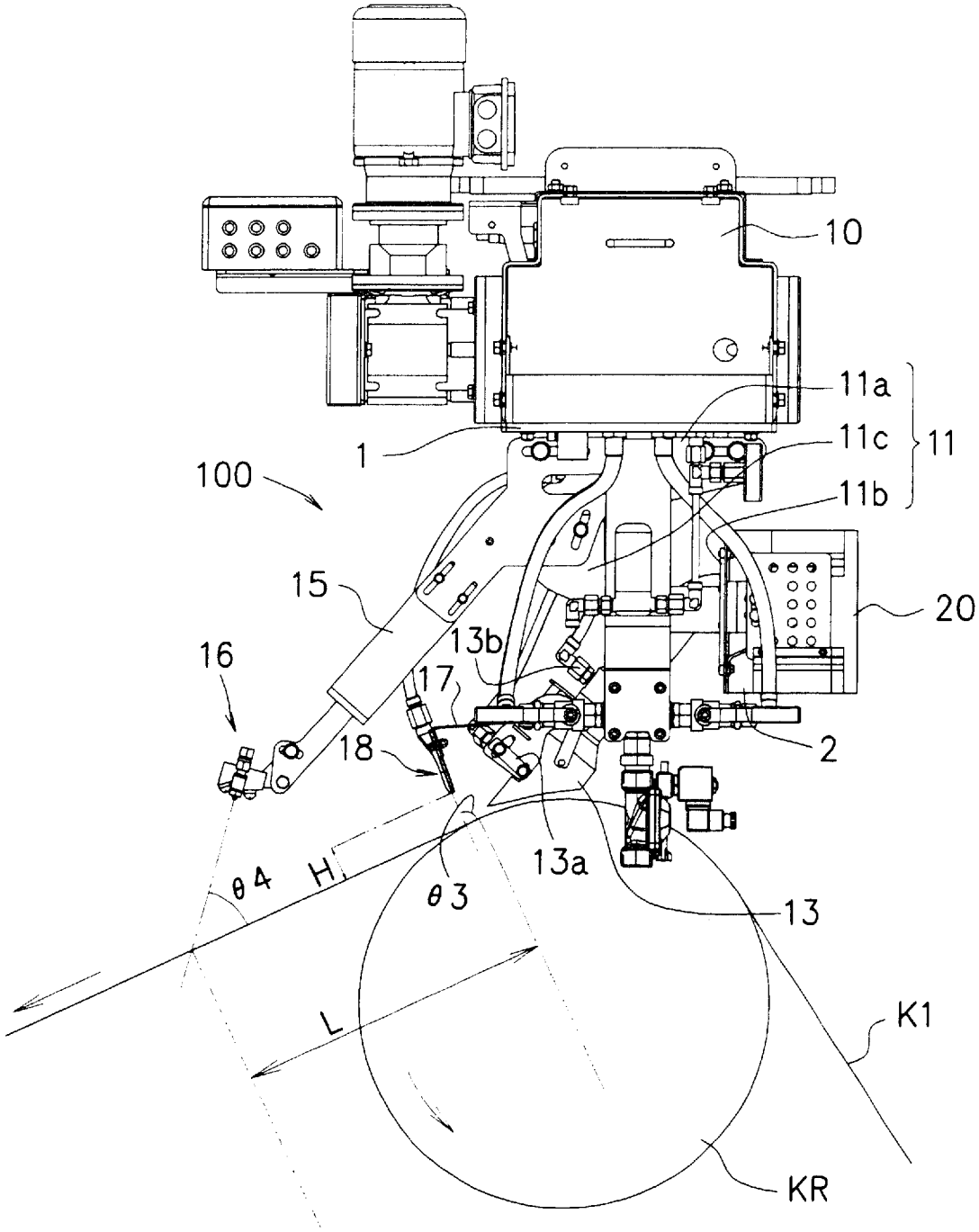
FIG. 3 is a side view showing the canvas cleaning device relating to the present embodiment.
Figure 4:
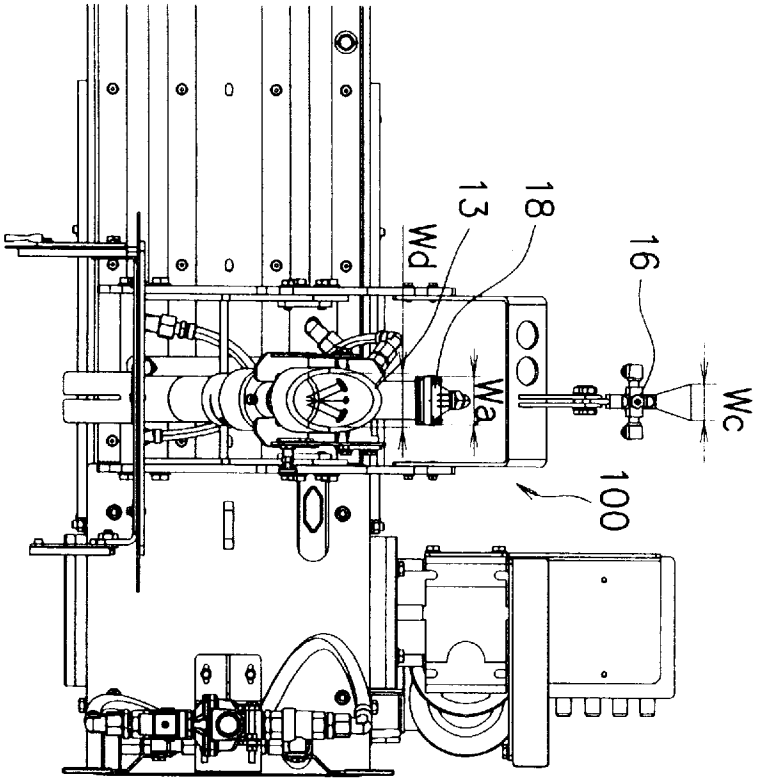
FIG. 4 is a bottom view showing the canvas cleaning device viewed from the canvas side in accordance with the present embodiment.

FIG. 3 is a side view showing the canvas cleaning device relating to the present embodiment, FIG. 4 is a bottom view showing the canvas cleaning device relating to the present embodiment, viewed from the canvas side.

As shown in FIG. 3, the canvas cleaning device 100 is provided with a base part 11 attached to a first rail part 1 on the bottom surface of the beam part 10 and a second rail part 2 on the side face of the save all part 20 so as to slide thereon, a cone part 13 attached to the base part 11, a high pressure water spraying device 13*a* installed inside the cone part 13, a negative pressure generating device 13*b* for setting the inside of the cone part 13 to a negative pressure, an arm part 15 that is extended to the downstream side from the base part 11, a nozzle device 16 attached to the tip of the arm part 15, an auxiliary arm part 17 attached to the cone part 13 and an air knife 18 attached to the tip of the auxiliary arm part 17.

In this manner, in the canvas cleaning device 100, at least the cone part 13 and the nozzle device 16 are integrally formed with the base part 11 interposed therebetween; therefore, the canvas cleaning device 100 itself can be made compacter.

Therefore, even when the drying part DP as a whole forms a small space from the designing point of view, it can be installed therein.

Moreover, since the distance between the cone part 13 and the nozzle device 16 can be desirably narrowed, re-adhesion of stains onto the canvas K1 can be prevented as much as possible between the cone part 13 and the nozzle device 16.

As shown in FIG. 4, in the canvas cleaning device 100, the cone part 13, the air knife 18 and the nozzle device 16 are disposed straightly in the transporting direction, and the cone part 13, the air knife 18 and the nozzle device 16 are disposed in this order from the upstream side to the downstream side.

Additionally, in the present specification, the upstream side means an upstream side relative to the direction in which the canvas is transported, and the downstream side means a downstream side relative to the direction in which the canvas is transported.

As shown in FIG. 3 again, in the canvas cleaning device 100, the cone part 13 is designed such that the high pressure water spraying device 13*a* sprays high pressure water onto the canvas K1 in a region surrounded by the cone part 13 relative to the canvas K1 so that stains (hereinafter, referred to simply as "stain"), such as pitch, paper powder and the like contained in the canvas K1, are extruded and these can be totally sucked by the negative pressure generating device 13*b*. Thus, stains adhered onto the canvas K1 are removed. Additionally, since the canvas cleaning device 100 is moved in the width direction of the canvas K1 along the first rail part 1 as described above, the removal of stains is subsequently carried out over the entire canvas K1.

When the canvas K1 from which stains have been removed through the cone part 13 is further transported toward the downstream side, air is next blown thereto by the air knife 18. Thus, even when the cone part 13 fails to sufficiently remove moisture, moisture contained in the canvas K1 can be sufficiently blown off.

When the canvas K1 from which moisture has been sufficiently removed by the air knife 18 is further transported toward the downstream side, chemical solution is next sprayed thereon by the nozzle device 16. That is, onto the canvas K1 from which stains have been removed through the cone part 13 and moisture has been removed by the air knife 18, chemical solution is applied. Thus, since the chemical solution is more easily adhered to the canvas K1, effects derived from the chemical solution can be sufficiently exerted.

The canvas K1 to which the chemical solution has been applied is then transported from the dryer roller D2 at the front end together with wet paper X while pressing the wet paper X, as shown in FIG. 1. At this time, in some cases, moisture contained in the wet paper X is transferred to the canvas K1 and stains are also adhered thereto.

Moreover, from the dryer roller D8 at the rear end, the canvas K1 is guided by the guide rollers KR, and the cleaning process is again carried out by the canvas cleaning device 100.

In the canvas cleaning device 100, the base part 11 is constituted by a first slide part 11*a* that is attached to the first rail part 1 on the lower surface of the beam part 10 so as to slide thereon, a second slide part 11*b* that is attached to the second rail part 2 on the side face of the downstream side of the save all part 20 so as to slide thereon and a bracket 11*c* that couples the first slide part 11*a* and the second slide part 11*b* with each other. That is, the base part 11 is integrally composed of the first slide part 11*a*, the second slide part 11*b* and the bracket 11*c*, and is made to be movable reciprocately along the longitudinal direction (width direction) of the first rail part 1 and the second rail part 2 that are disposed in parallel with each other.

In the canvas cleaning device 100, the cone part 13 is attached to the second slide part 11*b* of the base part 11.

Figure 5:
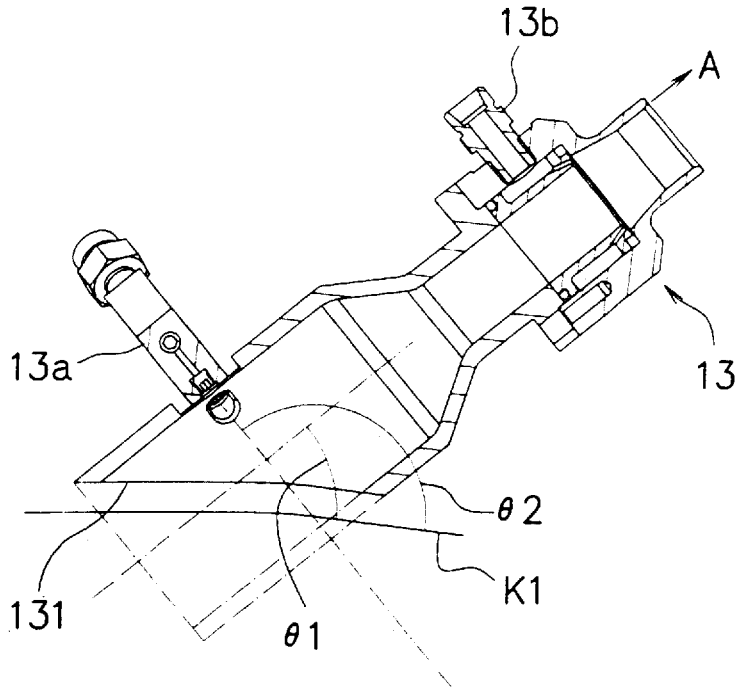
FIG. 5 is a transparent perspective view showing a cone part in the canvas cleaning device in accordance with the present embodiment.

FIG. 5 is a transparent perspective view showing the cone part in the canvas cleaning device relating to the present embodiment. Additionally, the description of the canvas K1 and the guide rollers KR is omitted.

As shown in FIG. 5, the cone part 13 formed into a cylinder shape has a structure extending straightly in a diagonally downward direction from the second slide part 11*b* of the base part 11. In this manner, since the cone part 13 has a straight shape, it can smoothly suck moisture and stains. In this case, when the cone part 13 has a bent structure, moisture and stains are sometimes accumulated on the bent portion inside the cone part.

The cone part 13 has its lower side positioned on the downstream side in comparison with its upper side, and is tilted relative to the canvas K1 surface in a manner so as to extend along the transporting direction of the canvas K1. For this reason, influences of a cocurrent flow accompanying with the transportation of the canvas K1 can be reduced as much as possible.

At this time, angle θ1 made by the transporting direction of the canvas K1 and the longitudinal direction of the cone part is preferably set in a range from 30 to 80°. When angle θ1 is less than 30°, a disadvantage is raised in that the surface of the canvas K1 hardly sucks moisture and stains on the surface of the canvas K1 in comparison with the case in which angle θ1 is within the above-mentioned range, and when angle θ1 exceeds 80°, a disadvantage is raised in that influences from a cocurrent flow are easily exerted to make the cone part 13 unstable in comparison with the case in which angle θ1 is within the above-mentioned range.

The cone part 13 has the high pressure water spraying device 13*a* for spraying high pressure water onto the canvas K1 installed inside thereof.

The high pressure water spraying device 13*a* is a device for spraying high pressure water directly toward the canvas K1 inside the cone part 13.

At this time, in the high pressure water spraying device 13*a*, the high pressure water is sprayed in the direction from the downstream side to the upstream side. Thus, stains adhered onto the canvas K1 can be extruded efficiently.

More specifically, angle θ2 made by the spraying direction of the high pressure water and the transporting direction of the canvas K1 is preferably set in a range from 90 to 150°. When angle θ2 is less than 90°, stains adhered to the canvas K1 might be intruded to the inside of the canvas K1 by being pressed by the high pressure water in comparison with the case in which angle θ2 is within the above-mentioned range, and when angle θ2 exceeds 150°, only the high pressure water might be bounced off, failing to extrude stains in comparison with the case in which angle θ2 is within the above-mentioned range.

Figure 6A:
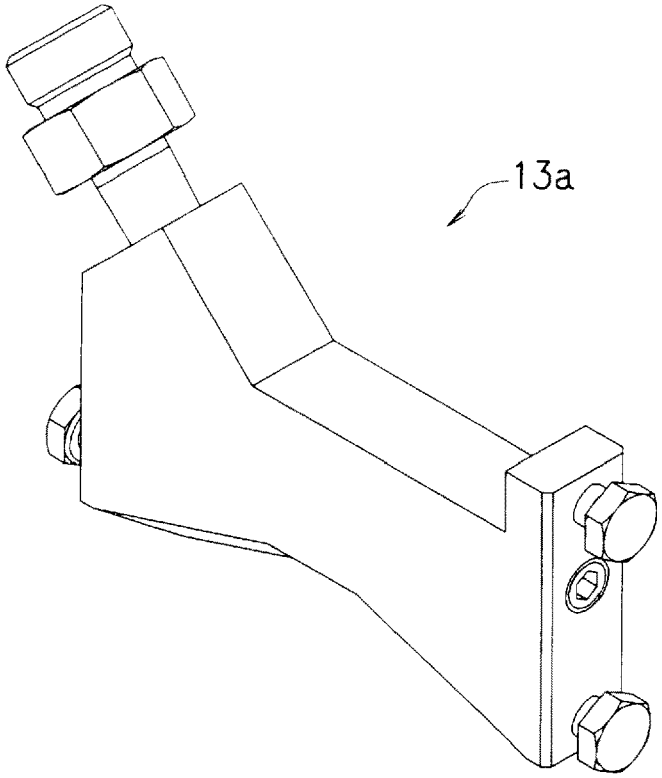
FIG. 6(*a*) is a perspective view showing a high pressure water spraying device in the canvas cleaning device in accordance with the present embodiment, and FIG. 6(*b*) is a cross-sectional view taken longitudinally along the longitudinal direction of the high pressure water spraying device.
Figure 6B:
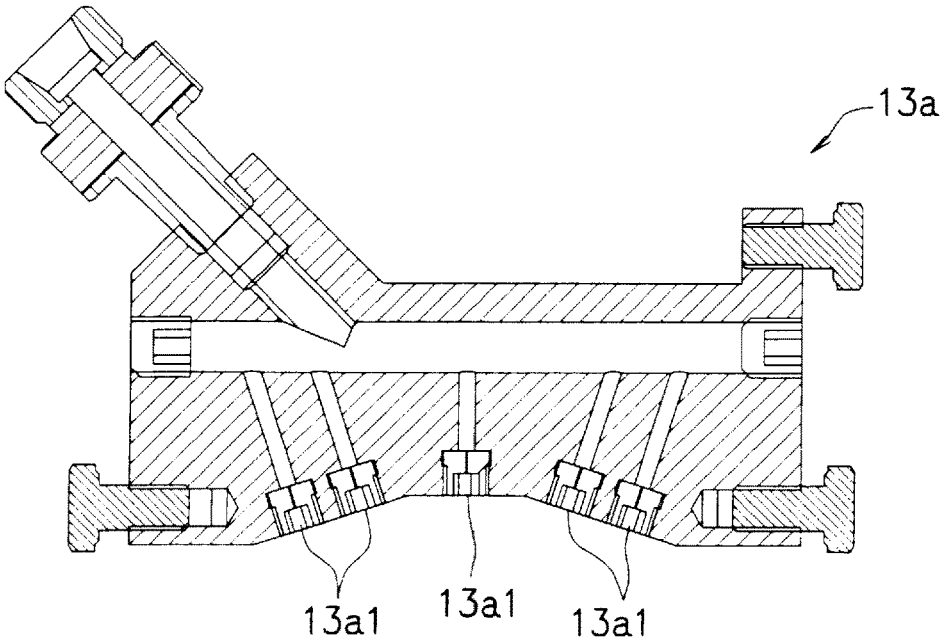

FIG. 6(*a*) is a perspective view showing a high pressure water spraying device in a canvas cleaning device relating to the present embodiment, and FIG. 6(*b*) is a cross-sectional view taken by longitudinally cutting the high pressure water spraying device along the longitudinal direction.

As shown in FIG. 6(*b*), the high pressure water spraying device 13*a* is provided with a plurality of high pressure water nozzles 13*a*1.

The high pressure water spraying device 13*a* is provided with five high pressure water nozzles 13*a*1.

Additionally, the number Nn of the high pressure water nozzles 13*a*1 in the high pressure water spraying device 13*a* is preferably set to 2 to 7. When the number Nn of the high pressure water nozzles 13*a*1 is less than 2, the width capable of cleaning becomes smaller in comparison with the case in which the number Nn of the high pressure water nozzles 13*a*1 is within the above-mentioned range, and a disadvantage is raised in that the spraying efficiency of high pressure water becomes worse, while in the case when the number Nn of the high pressure water nozzles 13*a*1 exceeds 7, the device becomes bulky in comparison with the case in which the number Nn of the high pressure water nozzles 13*a*1 is within the above-mentioned range, and a disadvantage is raised in that the impact force of the high pressure water sprayed from each of the high pressure water nozzles 13*a*1 easily becomes uneven.

The orifice diameter on of the high pressure water nozzle 13*a*1 is preferably set to 0.1 to 0.2 mm. When the orifice diameter on is less than 0.1 mm, the width capable of cleaning becomes smaller in comparison with the case in which the orifice diameter on is within the above-mentioned range, and a disadvantage is raised in that the spraying efficiency of high pressure water becomes worse, while in the case when the orifice diameter on exceeds 0.2 mm, a disadvantage is raised in that the impact force of the high pressure water blown from each of the high pressure water nozzles 13*a*1 tends to become weaker in comparison with the case in which the orifice diameter on is within the above-mentioned range.

As shown in FIG. 5 again, the cone part 13 has the negative pressure generating device 13*b* for setting the inside of the cone part 13 to a negative pressure installed inside thereof on the upper side than the high pressure water spraying device 13*a* inside thereof.

In the negative pressure generating device 13*b*, by allowing vacuum-use air to reversely flow in an arrow A direction by a compressor, as well as by changing the cross-sectional area of the flow, the inside of the cone part 13 located below the device is set to a negative pressure (Venturi effect). Thus, the high pressure water sprayed from the high pressure water spraying device 13*a* and stains extruded by the high pressure water are sucked. Additionally, the high pressure water and stains thus sucked are recovered through the above-mentioned save all part 20.

The cone part 13 has a structure that is cut out so that an end part 131 on the lower side thereof is made in parallel with the canvas K1. Thus, the end part 131 on the lower side of the cone part 13 is made close to the canvas K1 as much as possible so that suction of moisture and stains from the surface of the canvas K1 can be efficiently carried out.

Moreover, as described earlier, since the cone part is disposed so as to be tilted relative to the canvas K1, the area of the opening part of the end part 131 of the cone part 13 can be made larger as much as possible.

In the canvas cleaning device 100, in the opening part of the end part of the cone part 13, the diameter Wd (see FIG. 4) in the width direction on the cross section perpendicular to the longitudinal direction of the cone part 13 is preferably set to 0.04 to 0.5 m, and more preferably set to 0.04 to 0.07 m. When the diameter Wd is less than 0.04 m, the width capable of cleaning becomes smaller in comparison with the case in which the diameter Wd is within the above-mentioned range, with the result that a disadvantage is raised in that the cleaning efficiency becomes worse, while when the diameter Wd exceeds 0.5 m, a disadvantage is raised in that the suction force of moisture and stains by the negative pressure generating device 13*b* becomes insufficient in comparison with the case in which the diameter Wd is within the above-mentioned range.

As shown in FIG. 3 again, in the canvas cleaning device 100, an auxiliary arm part 17 extending to the downstream side from the cone part 13 is attached to the corresponding cone part 13.

Moreover, to the tip of the auxiliary arm part 17, the air knife 18 for blowing air to the canvas K1 is attached.

In the air knife 18, air is blown in a direction from the upstream side to the downstream side. Thus, moisture contained in the canvas K1 can be efficiently removed.

More specifically, angle θ3 made by the blowing direction of air and the transporting direction of the canvas K1 is preferably set in a range from 60 to 90°. In the case when angle θ3 is less than 60°, since the arrival of air to the canvas K1 is intervened with a cocurrent flow, moisture contained in the canvas K1 cannot be sufficiently removed in some cases in comparison with the case in which angle θ3 is within the above-mentioned range, while when angle θ3 exceeds 90°, stains and moisture that have been blown off might adhere to the outside of the air knife 18 and the cone part 13 in comparison with the case in which angle θ3 is within the above-mentioned range. Additionally, when the adhesion of stains is accumulated, the stains might come off and adhere to the canvas.

In the canvas cleaning device 100, the shortest distance H between the canvas K1 and the tip of the air knife 18 is preferably set to 10 to 20 mm. When the shortest distance H is less than 10 mm, stains and moisture that have been blown off might adhere to the outside of the air knife 18 and the cone part 13 in comparison with the case in which the shortest distance H is within the above-mentioned range, while when the shortest distance H exceeds 20 mm, air to be blown might be intervened with a cocurrent flow prior to the arrival to the canvas K1 in comparison with the case in which the shortest distance H is within the above-mentioned range.

In the canvas cleaning device 100, the air knife 18 is disposed at a position where no guide roller KR is located on the extending line in the blowing direction of air from the air knife 18. That is, in order not to make the extending line in the blowing direction of air from the air knife 18 overlapped with the guide roller KR, the length of the auxiliary arm part 17 and the blowing direction of air from the air knife 18 are adjusted. Thus, since air is allowed to pass through the canvas K1, moisture of the canvas K1 can be blown off more efficiently.

Figure 7:
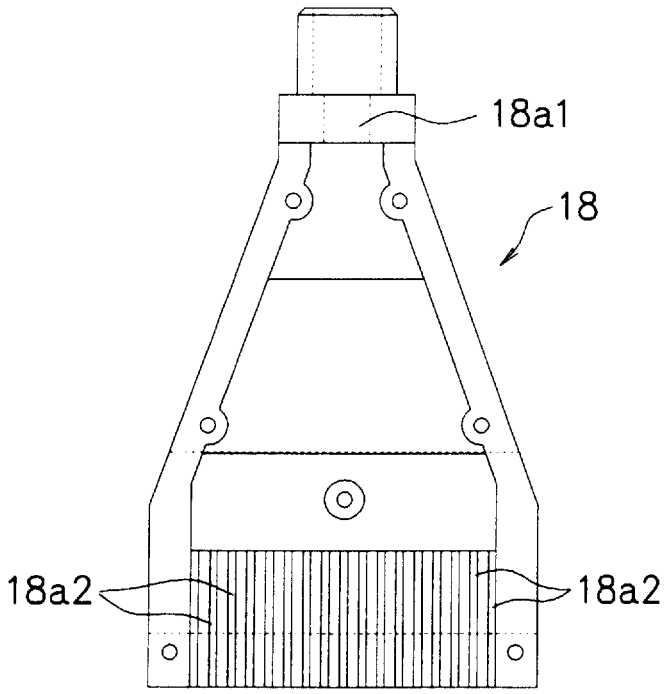
FIG. 7 is an exploded view of an air knife taken in the surface direction of the air knife in the canvas cleaning device in accordance with the present embodiment.

FIG. 7 is an exploded view made by cutting an air knife of the canvas cleaning device relating to the present embodiment in the surface direction of the air knife.

As shown in FIG. 7, the air knife 18 is provided with a blowing nozzle 18*a*1 capable of blowing air and a plurality of slits 18*a*2 from which air is discharged.

Moreover, a flow passage is widened from the blowing nozzle 18*a*1 toward the slit 18*a*2 on the opening part side. For this reason, the air knife 18 is capable of blowing air with a wide range relative to the canvas K1.

In the canvas cleaning device 100, air blowing width Wa (see FIG. 4) in the canvas K1 of air through which the air knife 18 instantaneously blows air is preferably made to satisfy the following relationship: Wd≤Wa relative to the diameter Wd in the width direction on the cross section perpendicular to the longitudinal direction of the cone part. In this case, after cleaning by the cone part 13, moisture remaining on the canvas can be positively blown off.

As shown in FIG. 3 again, in the canvas cleaning device 100, an arm part 15 is extended from the first slide part 11*a* of the base part 11 to the downstream side.

Moreover, a nozzle device 16 for spraying chemical solution onto the canvas K1 is attached to the tip of the arm part 15.

In the nozzle device 16, chemical solution is sprayed in a direction from the upstream side to the downstream side.

More specifically, angle θ4 made by the spraying direction of chemical solution and the transporting direction of the canvas K1 is preferably set in a range from 30 to 80°. In the case when angle θ4 is less than 30°, since the arrival of chemical solution to the canvas K1 is intervened by a cocurrent flow, the chemical solution cannot be sufficiently applied to the canvas K1 in some cases in comparison with the case in which angle θ4 is within the above-mentioned range, and when angle θ4 exceeds 80°, chemical solution sprayed thereon might be penetrated to the rear face of the canvas K1 to cause a failure in applying the chemical solution efficiently to the surface of the canvas K1 in some cases, in comparison with the case in which angle θ4 is within the above-mentioned range.

In the canvas cleaning device 100, distance L from a contact part at which the canvas K1 is released from the guide roller KR to a position at which the nozzle device 16 sprays chemical solution onto the canvas K1 is preferably set to 200 to 1000 mm. When distance L is less than 200 mm, a disadvantage is raised in that the sprayed chemical solution is easily penetrated to the rear side of the canvas K1 by a negative pressure generated when the canvas K1 is released from the guide roller KR, in comparison with the case in which distance L is within the above-mentioned range, while in the case when distance L exceeds 1000 mm, stains might re-adhere between the cone part 13 and the nozzle device 16, in comparison with the case in which distance L is within the above-mentioned range.

Figure 8A:
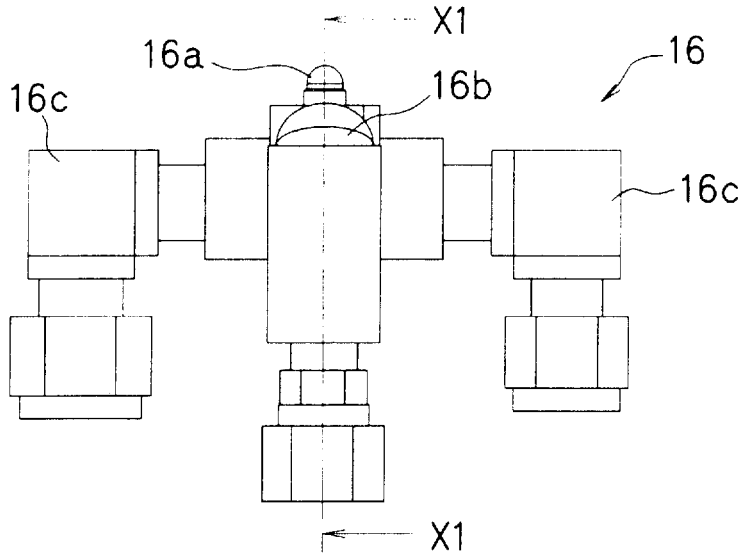
FIG. 8(*a*) is a side view showing a nozzle device of the canvas cleaning device in accordance with the present embodiment, FIG. 8(*b*) is a top view of FIG. 8(*a*) and FIG. 8(*c*) is a cross-sectional view taken along line X-X of FIG. 8(*a*).
Figure 8B:
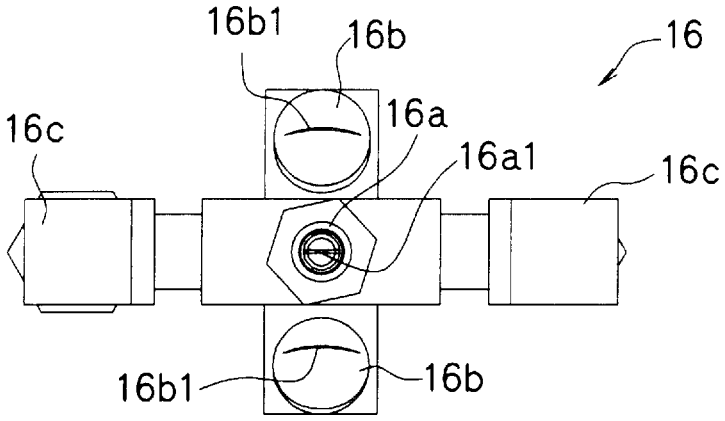
Figure 8C:
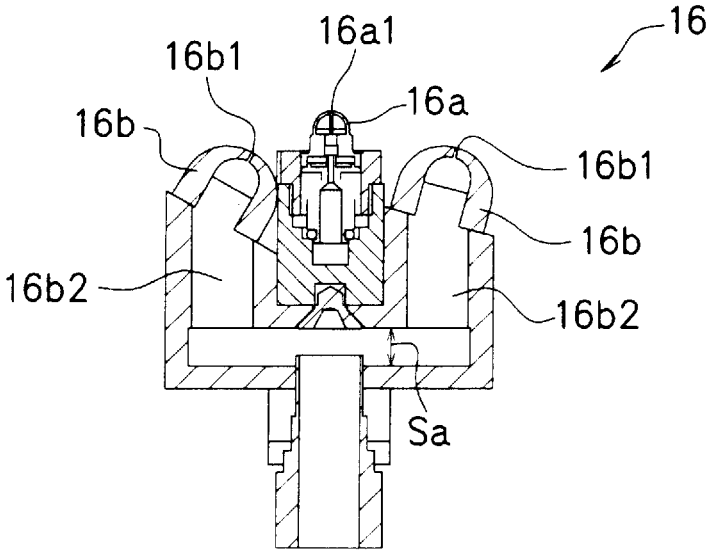

FIG. 8(*a*) is a side view showing a nozzle device of a canvas cleaning device relating to the present embodiment, FIG. 8(*b*) is a top view of FIG. 8(*a*), and FIG. 8(*c*) is a cross-sectional view taken along line X-X of FIG. 8(*a*).

As show in FIG. 8(*a*), FIG. 8(*b*) and FIG. 8(*c*), the nozzle device 16 is provided with a chemical solution nozzle part 16*a* for spraying chemical solution, a pair of air nozzle parts 16*b* formed so as to sandwich the chemical solution nozzle part 16*a* and support parts 16*c* on the two sides for supporting these.

Moreover, a chemical solution nozzle opening 16*a*1 formed in the chemical solution nozzle part 16*a* and air nozzle openings 16*b*1 respectively formed on a pair of air nozzle parts 16*b* are disposed along the transporting direction of the canvas K1.

In the nozzle device 16, air sprayed from the air nozzle opening 16*b*1 on the upstream side blocks a cocurrent flow accompanying with the transportation of the canvas K1, and exerts a function for suppressing chemical solution to which air blown from the air nozzle opening 16*b*1 on the downstream side is applied from scattering. For this reason, by spraying chemical solution from the chemical solution nozzle opening 16*a*1 sandwiched between the air nozzle openings 16*b*1 on the two sides, the chemical solution is allowed to efficiently reach the canvas K1, and the chemical solution thus reached is prevented from being scattered. With these arrangements, the nozzle device 16 makes it possible to efficiently apply the chemical solution to the canvas K1.

As shown in FIG. 8(*c*), in the nozzle device 16, an air flow passage 16*b*2 through which air to be blown from the air nozzle opening 16*b* passes is formed inside the air nozzle part 16*b*. That is, the air flow passage 16*b*2 is communicated with the plural air nozzle openings 16*b*1 of the air nozzle part 16.

In the nozzle device 16, the minimum cross-sectional area Sa of the air flow passage 16*b*2 is preferably set to 4 to 15 $mm^2$. When the minimum cross-sectional area Sa is less than 4 $mm^2$, disadvantages are raised in that the flow of air deteriorates and the pressure inside the air flow passage 16*b*2 becomes extremely high, in comparison with the case in which the minimum cross-sectional area Sa is in the above-mentioned range, while when the minimum cross-sectional area Sa exceeds 15 $mm^2$, air cannot be blown with sufficient force in some cases, in comparison with the case in which the minimum cross-sectional area Sa is in the above-mentioned range.

In the canvas cleaning device 100, chemical solution blowing width Wc (see FIG. 4) on the canvas K1 of chemical solution instantaneously blown by the nozzle device 16 is preferably set in a range from 0.015 to 0.2 m, and more preferably, from 0.015 to 0.04 m. In the case when chemical solution blowing width Wc is less than 0.015 m, since the width capable of applying the chemical solution becomes smaller, in comparison with the case in which chemical solution blowing width Wc is in the above-mentioned range, a disadvantage is raised in that the cleaning efficiency deteriorates, while in the case when chemical solution blowing width Wc exceeds 0.2 m, since the blowing amount of chemical solution becomes smaller, in comparison with the case in which chemical solution blowing width Wc is in the above-mentioned range, unevenness might be caused.

Relative to the air blowing width Wa in the canvas K1 of air instantaneously blown by the air knife 18, chemical solution blowing width Wc is preferably made to satisfy the following relationship: Wc≤Wa. In this case, since the nozzle device positively applies the chemical solution to a portion from which moisture remaining on the canvas has been blown off, effects derived from the chemical solution can be sufficiently exerted.

Moreover, the diameter Wd in the width direction of the above-mentioned cone part 13 and the chemical solution blowing width Wc are preferably made to satisfy the following relationship: Wc≤Wd. In this manner, by making the diameter Wd in the width direction of the cone part 13 larger than the chemical solution blowing width Wc, it becomes possible to apply the chemical solution to a portion which has been positively cleaned.

Therefore, in the canvas cleaning device 100, by satisfying the above-mentioned relationship, the chemical solution can be applied to the canvas K1 in a state in which stains and moisture have been removed more sufficiently.

With respect to the chemical solution to be sprayed from the nozzle device 16, a stain preventive agent composition, a separating agent composition, a cleaning agent composition or the like can be listed.

Among these, the chemical solution is preferably set as the stain preventive agent composition containing at least a stain preventive agent and water. In this case, it becomes possible to suppress paper powder and pitch contained in wet paper from adhering to the dryer rollers.

The stain preventive agent preferably contains at least one kind selected from the group consisting of amino modified silicone oil, epoxy modified silicone oil, polyether modified silicone oil, polybutene, vegetable oil and synthetic ester oil, and more preferably contains amino modified silicone oil or synthetic ester oil.

In this case, when the stain preventive agent contains at least one kind of silicone based oil selected from the group consisting of amino modified silicone oil, epoxy modified silicone oil and polyether modified silicone oil, the pH is preferably set in a range from 3.0 to 6.5, and more preferably, in a range from 3.0 to 6.0.

Moreover, in this case, the median diameter is preferably set in a range from 0.05 to 1.2 μm.

Furthermore, in this case, the viscosity is preferably set to 1000 mP·s or less, and more preferably, to 100 mP·s or less.

Moreover, the zeta potential is preferably set to 23 to 80 mV.

On the other hand, in the case when the stain preventive agent contains at least one kind of non-silicone based oil selected from the group consisting of polybutene, vegetable oil and synthetic ester oil, the pH is preferably set to 8.5 to 10.5.

In this case, the median diameter is preferably set to 0.05 to 1.2 μm.

Moreover, in this case, the viscosity is preferably set to 100 mP·s or less.

Furthermore, in this case, the zeta potential is preferably set to −80 to −15 mV.

Additionally, the absolute value of the zeta potential of the chemical solution is preferably set to 3 to 100 mV, and more preferably, to 20 to 80 mV. In the case when the absolute value of the zeta potential is less than 3 mV, since the adsorption force onto the canvas K1 of chemical solution becomes smaller in comparison with the case in which the absolute value of the zeta potential is in the above-mentioned range, the amount of chemical solution remaining on the canvas K1 might become insufficient, while in the case when the absolute value of the zeta potential exceeds 100 mV, since the adsorption force onto the canvas K1 of chemical solution becomes greater in comparison with the case in which the absolute value of the zeta potential is in the above-mentioned range, the amount of chemical solution remaining on the canvas K1 becomes too much, with the result that the corresponding canvas K1 might be stained by solid components contained in the chemical solution itself.

Next, explanation will be given on the cleaning method of a canvas in which the above-mentioned canvas cleaning device 100 is used.

In the canvas cleaning method, supply water amount Qw of high pressure water to be sprayed by the high pressure water spraying device 13*a* is preferably set to 500 to 5000 ml/min, and more preferably, to 500 to 1500 ml/min. In the case when supply water amount Qw is less than 500 ml/min, a disadvantage is raised in that stains adhered to the canvas K1 are insufficiently excluded in comparison with the case in which the supply water amount Qw is within the above-mentioned range, while in the case when supply water amount Qw exceeds 5000 ml/min, a disadvantage is raised in that moisture remaining on the canvas K1 becomes excessive in comparison with the case in which the supply water amount Qw is within the above-mentioned range, with the result that the suction efficiency might be lowered.

In the canvas cleaning method, the water pressure of high pressure water to be sprayed by the high pressure water spraying device 13*a* is preferably set to 15 to 45 MPa and more preferably, to 15 to 30 MPa. In the case when the water pressure is less than 15 MPa, extrusion of stains by the spraying of high pressure water might become insufficient in some cases in comparison with the case in which the water pressure is within the above-mentioned range, while in the case when the water pressure exceeds 45 MPa, the coat film by the chemical solution formed on the canvas K1 might be damaged in comparison with the case in which the water pressure is within the above-mentioned range. Additionally, the coat film formed by the chemical solution means a coat film, which is formed by spraying the chemical solution through the nozzle device 16, and when, after the formation of the coat film, the canvas K1 makes one turn and is again returned to the canvas cleaning device 100, which also remains on the canvas K1.

In the canvas cleaning method, impact F of high pressure water to be sprayed by the high pressure water spraying device 13*a* is preferably set to 160 to 500 g. In the case when impact F is less than 160 g, a disadvantage is raised in that force for spraying the high pressure water becomes insufficient, causing the extrusion of stains adhered to the canvas K1 to become insufficient, in comparison with the case in which impact F is within the above-mentioned range, while in the case when impact F exceeds 500 g, the coat film by the chemical solution formed on the canvas K1 might be damaged in comparison with the case in which impact F is within the above-mentioned range.

In the canvas cleaning device 100, impact F, as well as the aforementioned orifice diameter on of the high pressure water nozzle 13*a*1 and the number Nn of the nozzles, preferably satisfy the following relationship: $2 \leq F \times (\varnothing n/2)^2 \pi \times Nn \leq 15$. In this case, upon spraying high pressure water, impact to be applied to the canvas K1 is set to an appropriate value. That is, stains adhered to the canvas K1 can be sufficiently extruded, and it is also possible to suppress the canvas K1 from being damaged.

In the canvas cleaning method, recovery amount Qa of high pressure water (moisture) given by the negative pressure generating device 13*b* is preferably set to 200 to 4850 ml/min, more preferably, to 200 to 1455 ml/min, and most preferably, to 400 to 1350 ml/min. In the case when recovery amount Qa is less than 200 ml/min, much moisture might remain on the canvas K1 in comparison with the case in which recovery amount Qa is in the above-mentioned range, while in the case when recovery amount Qa exceeds 4850 ml/min, the canvas K1 itself might be sucked to adhere to the cone, and damaged, in comparison with the case in which recovery amount Qa is in the above-mentioned range.

In the canvas cleaning method, applied amount (effective component amount) Qc of the effective component of chemical solution by the nozzle device 16 is preferably set to 150 to 20000 mg/min. In the case when applied amount Qc is less than 150 mg/min, effects derived from chemical solution might not be sufficiently exerted in some cases, in comparison with the case in which applied amount Qc is in the above-mentioned range, while when applied amount Qc exceeds 20000 mg/min, the chemical solution itself might be solidified to cause stains in comparison with the case in which applied amount Qc is in the above-mentioned range.

Additionally, in the present specification, "effective component" refers to a component of the composition of the chemical solution from which water is excluded, and "effective component amount" refers to the total mass of the component from which water is excluded.

In the cleaning method of the canvas, water amount Qn to be removed by the air knife 18 of water (high pressure water) sprayed onto the canvas from the high pressure water spraying device 13*a* is preferably set to 200 to 1455 ml/min. In the case when water amount Qn to be removed is less than 200 ml/min, much moisture is contained in the canvas, failing to sufficiently hold chemical solution to be applied to the canvas in some cases, in comparison with the case in which water amount Qn to be removed is in the above-mentioned range, while water amount Qn to be removed exceeds 1455 ml/min, the canvas might be damaged.

In this case, supply water amount Qw, recovery amount Qa and applied amount Qc preferably satisfy the following relationship:

$$(Qw-Qa)/Qc \leq 25$$

Moreover, supply water amount Qw, recovery amount Qa, removed water amount Qn and applied amount Qc preferably satisfy the following relationship:

$$(Qw-Qa-Qn)/Qc \leq 15$$

In these cases, effects derived from the chemical solution can be sufficiently exerted.

Figure 9:
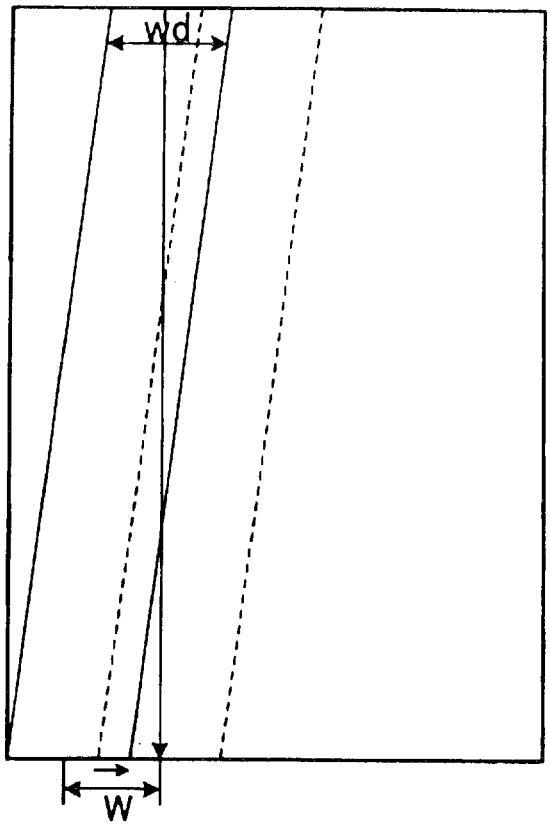
FIG. 9(*a*) and FIG. 9(*b*) are development views corresponding to one turn of a canvas that explain the relationship between the diameter in the width direction of the cone part and the distance through which the canvas cleaning device slides in the canvas cleaning device in accordance with the present embodiment.
Figure 9B:
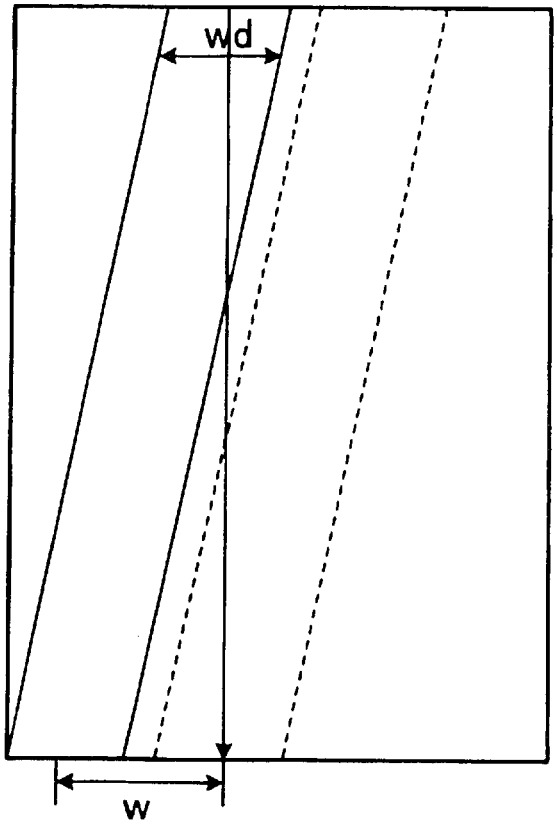

FIG. 9(*a*) and FIG. 9(*b*) are development views corresponding to one turn of the canvas, which explain a relationship between the diameter in the width direction of the cone part and the distance through which the canvas cleaning device slides in the canvas cleaning device in accordance with the present embodiment.

For example, as shown in FIG. 9(*a*), in the case when diameter Wd in the width direction of the cone part 13 is greater than distance W through which the base part 11 (cone part 13) slides while the canvas K1 makes one turn, regions for removing stains are mutually overlapped with each other. On the other hand, as shown in FIG. 9(*b*), in the case when diameter Wd in the width direction of the cone part 13 is smaller than distance W through which the base part 11 (cone part 13) slides while the canvas K1 makes one turn, a gap is generated between the mutual spraying parts.

Therefore, distance W through which the base part 11 of the canvas cleaning device 100 slides while the canvas K1 makes one turn preferably satisfies the following relationship relative to the above-mentioned diameter Wd: $0.01\ Wd \leq W \leq 3\ Wd$, and more preferably satisfies the following relationship: $0.8\ Wd \leq W \leq 3\ Wd$. In this case, the mutual regions for removing stains are not overlapped with each other as much as possible so that it is possible to prevent the gap from being generated as much as possible. Additionally, by allowing the relationship Wd=W to be satisfied, the spraying process of high pressure water by the high pressure water spraying device 13*a* and the suction process by the negative pressure generating device 13*b* can be carried out evenly on the entire canvas K1.

Next, explanation will be given on a canvas cleaning mechanism provided with the above-mentioned canvas cleaning device 100.

The canvas cleaning mechanism is provided with at least the canvas cleaning device 100 and the recovery box 21. That is, in the canvas cleaning mechanism, the canvas cleaning device 100 and the recovery box 21 form a set.

In the canvas cleaning mechanism, the canvas cleaning device 100 is provided with the cone part 13 that is installed at a position opposed to the guide roller KR with the canvas K1 interposed therebetween.

On the other hand, the recovery box 21 is installed below the guide roller KR.

The recovery box 21 has a box shape that extends in the width direction of the canvas, with its upper surface opened.

Moreover, on the bottom wall of the recovery box 21, a drain water opening is formed, and the bottom wall is slightly slanted so as to guide water to be recovered toward the drain water opening.

In the canvas cleaning mechanism, when high pressure water is sprayed onto the canvas K1 by the canvas cleaning device 100, water that has passed through the canvas K1 drops through the guide roller KR.

Moreover, the dropped water is housed in the recovery box 21 below the guide roller KR, and is also discharged from the drain water opening guided onto the bottom wall.

In the canvas cleaning mechanism, since the canvas cleaning device 100 is installed, the above-mentioned effects can be obtained, and since the recovery box 21 is installed, water dropped from the guide roller KR is prevented from adhering to wet paper X and other portions.

As described above, explanation has been given on preferred embodiments of the present invention; however, the present invention is not intended to be limited by the above-mentioned embodiments.

In the canvas cleaning device 100 relating to the present embodiment, the cleaning process is carried out on the canvas K1 shown in FIG. 1; however, the cleaning process may be carried out on the canvas K2, and the cleaning process may be carried out on both of the canvases.

Moreover, with respect to the canvases K1 and K2, a plurality of the canvas cleaning devices 100 may be installed.

The canvas cleaning device 100 relating to the present embodiment is made to be slidable along the first rail part 1 and the second rail part 2; however, this may be made slidable along at least either one of the rail parts.

Moreover, the rail part is not necessarily required to be attached to the beam part 10 or the save all part 20, and the presence or absent of the beam part 10 and save all part 20 is not necessarily required.

In the canvas cleaning device 100 relating to the present embodiment, the base part 11 is constituted by the first slide part 11*a*, the second slide part 11*b* and the bracket 11*c*; however, the present invention is not intended to be limited by this structure. That is, it may be at least slidable along the rail part, and the cone part 13 and the nozzle device 16 may be connected thereto directly or indirectly.

In the canvas cleaning device 100 relating to the present embodiment, the negative pressure generating device 13*b* is attached to the cone part 13; however, this structure is not necessarily required.

In the same manner, in the canvas cleaning device 100, the air knife 18 is attached; however, this is not necessarily required.

In the canvas cleaning device 100 relating to the present embodiment, the auxiliary arm part 17 is attached to the cone part 13; however, instead of the cone part 13, this may be attached to the base part 11, or may be attached to the arm part 15.

In the canvas cleaning mechanism relating to the present embodiment, as shown in FIG. 1, the recovery box 21 is installed at one portion of the guide roller KR; however, a plurality of them may be installed at a plurality of portions.

INDUSTRIAL APPLICABILITY

The canvas cleaning device 100 relating to the present invention is used as a device for cleaning a canvas to be used in a drying part of a paper machine while transporting the canvas.

In accordance with the canvas cleaning device 100 of the present invention, stains are prevented from re-adhering as much as possible, and the canvas can be cleaned efficiently.

REFERENCE SIGNS LIST

1 . . . rail part (first rail part),
10 . . . beam part,
11 . . . base part,
11*a* . . . first slide part,
11*b* . . . second slide part,
13 . . . cone part,
131 . . . end part,
13*a* . . . high pressure water spraying device,
13*a*1 . . . high pressure water nozzle,
13*b* . . . negative pressure generating device,
15 . . . arm part,
16 . . . nozzle device,
16*a* . . . chemical solution nozzle part,
16*a*1 . . . chemical solution nozzle opening,
16*b* . . . air nozzle part,
16*b*1 . . . air nozzle opening,
16*b*2 . . . air flow passage,
16*c* . . . support part,
17 . . . auxiliary arm part,
18 . . . air knife,
18*a*1 . . . spraying nozzle,
18*a*2 . . . slit,
100 . . . canvas cleaning device,
2 . . . rail part (second rail part),
20 . . . save all part,
21 . . . recovery box,
B . . . breaker stack roller,
C . . . calendar roller,
DP . . . driver part,
D1, D2, D3, D4, D5, D6, D7, D8 . . . dryer roller,
H . . . shortest distance,
K1, K2 . . . canvas,
KR . . . guide roller,
L, W . . . distance,
Wa . . . air spraying width,
Wc . . . chemical solution spraying width,
Wd . . . diameter in the width direction of cone part,
X . . . wet paper,
θ1, θ2, θ3, θ4 . . . angle

The invention claimed is:

1. A canvas cleaning device for cleaning a canvas of a paper machine while transporting the canvas, comprising:

a base part that is slidable along a rail part extending in the width direction of the canvas;

a cone part that is attached to the base part so as to extend straightly;

a high pressure water spraying device for spraying high pressure water onto the canvas formed inside the cone part;

an arm part that is formed so as to extend onto a downstream side from the base part;

a nozzle device that is attached to the tip of the arm part and used for spraying a chemical solution onto the canvas; and a negative pressure generating device for setting the inside of the cone part to a negative pressure, wherein the cone part and the nozzle device are disposed straightly along the transporting direction, the nozzle device is positioned on the downstream side from the cone part; and inside the cone part, high pressure water is sprayed from the high pressure water spraying device onto the canvas, with the high pressure water being sucked by the negative pressure generating device.

2. The canvas cleaning device according to claim 1, wherein the cone part is installed at a position opposed to a guide roller for guiding the canvas, with the canvas being interposed therebetween, and the distance from a contact part at which the canvas is released from the guide roller to a position at which the nozzle device sprays the chemical solution onto the canvas is set to 200 to 1000 mm.

3. The canvas cleaning device according to claim 1, wherein the chemical solution is a stain preventive agent composition including at least one kind selected from the group consisting of amino modified silicone oil, epoxy modified silicone oil, polyether modified silicone oil, polybutene, vegetable oil and synthetic ester oil, and the chemical solution has an absolute value of zeta potential in a range from 3 to 100 mV.

4. The canvas cleaning device according to claim 1, wherein the cone part has diameter Wd in the width direction on a cross section perpendicular to the longitudinal direction that is set to 0.04 to 0.5 m and the nozzle device has chemical solution spraying width Wc on the canvas of the chemical solution, which is instantaneously sprayed therefrom, and set to 0.015 to 0.2 m, and diameter Wd and chemical solution spraying width Wc satisfy the following relationship: $Wc \leq Wd$.

5. A canvas cleaning mechanism comprising: the canvas cleaning device according to claim 1; and a recovery box for recovering water dropped from a guide roller for guiding the canvas, wherein the recovery box has a box shape extending in the width direction of the canvas, with the upper surface being opened, and the recovery box is disposed below the guide roller.

6. A canvas cleaning device for cleaning a canvas of a paper machine while transporting the canvas, comprising:

a base part that is slidable along a rail part extending in the width direction of the canvas;

a cone part that is attached to the base part so as to extend straightly;

a high pressure water spraying device for spraying high pressure water onto the canvas formed inside the cone part;

an arm part that is formed so as to extend onto a downstream side from the base part; and a nozzle device that is attached to the tip of the arm part and used for spraying a chemical solution onto the canvas, wherein the cone part and the nozzle device are disposed straightly along the transporting direction, the nozzle device is positioned on the downstream side from the cone part; and inside the cone part, the high pressure water is sprayed onto the canvas from the high pressure water spraying device, wherein the nozzle device comprises a chemical solution nozzle part for spraying a chemical solution and a pair of air nozzle parts formed so as to sandwich the chemical solution nozzle part, and wherein the chemical solution nozzle part and the pair of air nozzle parts are disposed straightly along the transporting direction.

7. The canvas cleaning device according to claim 6, further comprising:

an auxiliary arm part attached to the base part, the arm part or the cone part;

an air knife for blowing air to the canvas, attached to the tip of the auxiliary arm part, and a negative pressure generating device for setting the inside of the cone part to a negative pressure, wherein the cone part, the air knife and the nozzle device are disposed straightly along the transporting direction, with the air knife being located between the cone part and the nozzle device, and high pressure water is sprayed to the canvas from the high pressure water spraying device inside the cone, with the high pressure water being sucked by the negative pressure generating device.

8. The canvas cleaning device according to claim 7, wherein the cone part has diameter Wd in the width direction on a cross section perpendicular to the longitudinal direction that is set to 0.04 to 0.5 m and the nozzle device has chemical solution spraying width Wc on the canvas of the chemical solution, which is instantaneously sprayed therefrom, and set to 0.015 to 0.2 m, and diameter Wd and chemical solution spraying width Wc satisfy the following relationship: $Wc \leq Wd$.

9. The canvas cleaning device according to claim 6, wherein the cone part is installed at a position opposed to a guide roller for guiding the canvas, with the canvas being interposed therebetween, and the distance from a contact part at which the canvas is released from the guide roller to a position at which the nozzle device sprays the chemical solution onto the canvas is set to 200 to 1000 mm.

10. The canvas cleaning device according to claim 6, wherein the chemical solution is a stain preventive agent composition including at least one kind selected from the group consisting of amino modified silicone oil, epoxy modified silicone oil, polyether modified silicone oil, polybutene, vegetable oil and synthetic ester oil, and the chemical solution has an absolute value of zeta potential in a range from 3 to 100 mV.

11. A canvas cleaning device for cleaning a canvas of a paper machine while transporting the canvas, comprising:

a base part that is slidable along a rail part extending in the width direction of the canvas;

a cone part that is attached to the base part so as to extend straightly;

a high pressure water spraying device for spraying high pressure water onto the canvas formed inside the cone part;

an arm part that is formed so as to extend onto a downstream side from the base part;

a nozzle device that is attached to the tip of the arm part and used for spraying a chemical solution onto the canvas;

an auxiliary arm part attached to the base part, the arm part or the cone part; and an air knife for blowing air to the canvas attached to the tip of the auxiliary arm part, wherein the cone part and the nozzle device are disposed straightly along the transporting direction, the nozzle device is positioned on the downstream side from the cone part; and inside the cone part, the high pressure water is sprayed onto the canvas from the high pressure water spraying device, wherein the cone part, the air knife and the nozzle device are disposed straightly along the transporting direction, with the air knife being located between the cone part and the nozzle device.

12. The canvas cleaning device according to claim 11, wherein the cone part has diameter Wd in the width direction on a cross section perpendicular to the longitudinal direction that is set to 0.04 to 0.5 m and the nozzle device has chemical solution spraying width Wc on the canvas of the chemical solution, which is instantaneously sprayed therefrom, and set to 0.015 to 0.2 m, and diameter Wd and chemical solution spraying width Wc satisfy the following relationship: $Wc \leq Wd$.

13. The canvas cleaning device according to claim 11, wherein the cone part is installed at a position opposed to a guide roller for guiding the canvas, with the canvas being interposed therebetween, and the distance from a contact part at which the canvas is released from the guide roller to a position at which the nozzle device sprays the chemical solution onto the canvas is set to 200 to 1000 mm.

14. The canvas cleaning device according to claim 11, wherein the chemical solution is a stain preventive agent composition including at least one kind selected from the group consisting of amino modified silicone oil, epoxy modified silicone oil, polyether modified silicone oil, polybutene, vegetable oil and synthetic ester oil, and the chemical solution has an absolute value of zeta potential in a range from 3 to 100 mV.

* * * * *